US005205118A

United States Patent [19]

Stahlecker

[11] Patent Number: 5,205,118

[45] Date of Patent: Apr. 27, 1993

[54] PROCESS AND AN ARRANGEMENT FOR EXCHANGING SPOOLS AND PACKAGES AT AN INDIVIDUAL SPINNING UNIT OF A SPINNING MACHINE

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany

[21] Appl. No.: 496,690

[22] Filed: Mar. 21, 1990

[30] Foreign Application Priority Data

Mar. 22, 1989 [DE] Fed. Rep. of Germany ..... 3909420

[51] Int. Cl.[5] ..... D01H 9/00; D01H 7/92; D02G 1/16; B65H 54/00

[52] U.S. Cl. ..... 57/269; 57/299; 57/328; 57/333; 242/18 EW

[58] Field of Search ..... 57/261, 266, 264, 268, 57/270, 276, 278, 281, 299, 328, 269, 333; 242/18 EW, 18 PW

[56] References Cited

U.S. PATENT DOCUMENTS 3,778,996 12/1973 Olson et al. ..... 57/299 X
3,940,075 2/1976 Lenk ..... 242/18 PW
4,102,508 7/1978 Stegelman ..... 242/18 PW
4,125,990 11/1978 Stahlecker et al. ..... 242/18 PW X
4,384,689 5/1983 Bloomfield et al. ..... 242/18 EW X
4,833,874 5/1989 Stahlecker et al. ..... 57/266 X
4,909,451 3/1990 Kuepper et al. ..... 57/299 X
4,944,145 7/1990 Stahlecker ..... 57/261
5,016,829 5/1991 Schippers et al. ..... 242/18 PW

FOREIGN PATENT DOCUMENTS 1760243 4/1958 Fed. Rep. of Germany .
3634464 4/1988 Fed. Rep. of Germany .

*Primary Examiner*—Daniel P. Stodola
*Assistant Examiner*—Michael R. Mansen
*Attorney, Agent, or Firm*—Evenson, McKeown, Edwards & Lenahan

[57] ABSTRACT

For a changing of spool tubes and packages at an individual spinning unit of a spinning machine having a plurality of such spinning units, it is provided that, when a given filling ratio is reached, the yarn which continues to move to the spool package is disengaged from a cross-winding yarn guide and is subsequently, in the form of final windings, wound onto an area limited in longitudinal direction of the spool package onto the spool package.

40 Claims, 4 Drawing Sheets 59
58
60

36
35
53
85
69
71
59
45
51
50
58
14'
14
54
52
43
30
65
70
40
56
37
38
61
63
46,47
54'
42
57
48
37'
57'
55
37''
44

35
36
45
53
75
74
85
71
69
14'
43
30
52
70
56
40
57'
68
54'
38'
37'
67
55

PROCESS AND AN ARRANGEMENT FOR EXCHANGING SPOOLS AND PACKAGES AT AN INDIVIDUAL SPINNING UNIT OF A SPINNING MACHINE

BACKGROUND AND SUMMARY OF THE INVENTION

The invention relates to a process and an arrangement for exchanging spools and packages at an individual spinning unit of a spinning machine having a plurality of spinning units of this type which each produce at least one yarn which is withdrawn by means of a withdrawal device and is wound onto a spool package by means of a winding device which contains a cross-winding yarn guide distributing the yarn in longitudinal direction of the spool package, in which case, after a given filling ratio of the spool package is reached, the further yarn production at the respective spinning unit is interrupted and a yarn end is wound onto the spool package.

In certain spinning processes, particularly in ring spinning, it is customary that, at the end of a package build-up, i.e., before the package is exchanged for a spool, a yarn reserve is deposited at a certain point on the spinning package, such as an underwinding or an overwinding. As a result, it is achieved that the yarn guides (ring rail with traveller) are controlled correspondingly. In this case, it is a prerequisite that all spinning points terminate their package build-up at the same time, i.e., have reached the desired filling ratio at the same time. However, this is not the case in other spinning machines, for example, in the case of open-end rotor spinning or open-end air spinning and particularly also in the spinning process (DE-A 36 34 464) in which only two prestrengthened yarn components are spun which subsequently are wound onto a spool package as a double yarn. This package is used as a feeding package for a twisting operation. It frequently happens in this process that the spool packages, at the individual spinning points, have reached the given filling ratio at very different times. The spinning operation at these individual spinning units is then interrupted. In this case, the yarn end of the yarn moving through a cross-winding yarn guide is wound onto the spool package and will then be located at a not predetermined point somewhere on the circumference of the spool package. Frequently, there are problems in this case with respect to finding and withdrawing the yarn end, particularly for automatic devices which have the purpose of carrying out this work. These problems are particularly severe in the process in which the two only prestrengthened yarn components are wound onto a spool package as a double yarn. There is the added risk, in this case, that, on the one hand, the ends of the two yarn components are deposited at different points on the spool package so that they cannot be found simultaneously and therefore the double yarn cannot be withdrawn correctly. On the other hand, the strength of the two yarn components wound up as a double yarn is relatively low so that a yarn searching nozzle of an automatic device must not affect the surface of the spool package by means of a high pressure. Otherwise, there is the risk that the upper layers of the double yarn are damaged.

In the case of a spooling frame, it is also known (DE-A 17 60 243), when the given filling ratio of the spool package is reached, to lift the yarn at an unreduced speed out of the cross-winding yarn guide by means of a lever which can be brought into the moving path of the yarn and to deflect the yarn such that the final windings are deposited in parallel to a predetermined point.

An object of the invention is to provide a process and an arrangement of the initially mentioned type in which the refinding of a yarn end on the full package is facilitated particularly for automatic devices.

This object is achieved in that, when a given filling ratio is reached, the yarn which continues to move to the spool package is disengaged from the cross-winding yarn guide and subsequently, as final windings, is wound on an area delimited in longitudinal direction of the spool package, onto the spool package.

As a development of preferred embodiments of the invention, it is provided that when a given filling ratio is reached, the winding speed of the spool package is reduced.

By reducing the winding speed of the spool package, which particularly also includes a stopping of the spool package, the yarn tension is loosened to such an extent that the yarn can be lifted out of the cross-winding yarn guide without any difficulty. It may then be wound onto the spool package at a defined point without the occurrence of inadmissible loads. The finding of this yarn end will then be facilitated greatly for an automatic device. For this purpose, a suction nozzle is used, as a rule, which, corresponding to the possible depositing area, needs to be only relatively narrow. Since the yarn end can also be found within a relatively short time, the surface of the spool package is exposed to the suction effect only during a relatively short period of time.

In a further development of the invention, it is provided that the spool package is first separated from the winding device and then the yarn is disengaged from the cross-winding yarn guide, in which case the yarn which continues to be produced for a given time period is stored in a storage device connected behind the withdrawal device subsequently the yarn is wound up as final windings while the spool package is driven again while bypassing the cross-winding yarn guide. This results in the advantage that the spool package may have come to a standstill before the yarn is disengaged from the cross-winding yarn guide. The yarn which is then still contained in the storage device may then, at a later point in time, at an appropriate and particularly a reduced winding speed, be wound onto the spool package so that the yarn is not stressed unacceptably.

In a further development of the invention, it is provided that the yarn leaving the storage device is cut off in front of the end created by the interruption of the spinning operation. As a result, it is avoided that the usually thinned-out yarn end, which was created when the spinning unit was switched off, is wound onto the spool package.

In a further development of the invention, it is provided that the yarn end wound up during the formation of the final windings, particularly when a double yarn is produced from prestrengthened yarn components, is strengthened before moving onto the spool package. In this case, it is expedient for the ends of the two yarn components of a double yarn to be connected with one another before moving onto the spool package. As a result, it is achieved that the ends of the double yarn are definitely situated at the same point on the spool package and are also picked up simultaneously. In particular, in the case of a double yarn consisting of prestrengthened yarn components, it is expedient for the connecting of the two yarn components to take place along a certain length, for example, along a length of 0.5 meters. As a result, a yarn piece is available during the subsequent further processing which has a higher strength and can therefore be handled more easily and with a reduced risk of a yarn breakage. This prestrengthening and/or connecting with one another is also advantageous when the final windings are not deposited at a certain given point but are situated at a random point on the surface of the spool package determined by the cross-winding yarn guide.

In a further development of the invention, it is provided in an arrangement that devices for detecting the filling ratio of the spool package are connected to devices for reducing the winding speed and to devices for lifting the yarn out of the cross-winding yarn guide. In a first embodiment, it is provided that each spinning unit is equipped with devices for lifting the spool package off the winding device. In addition, it is provided in this case that each spinning unit is equipped with a yarn guiding device which can be brought into the moving path in front of the spool package. In addition it is provided in this embodiment in an expedient development that each spinning unit is equipped with a device for storing the spun yarn which is arranged behind the withdrawal device in the travel direction of the yarn. In order to obtain a reinforced end in this embodiment, each spinning unit is equipped with a device for the prestrengthening of the yarn which is preferably arranged in the travel direction of the yarn behind the device for the storing. It is also expedient for a cutting device to be provided which is connected behind the device for the storing in the travel direction of the yarn.

In another development of the invention, it is provided that a device for reducing the winding speed and/or devices for lifting the yarn out of the cross-winding yarn guide and/or a device for storing the yarn and/or a device for interrupting the spinning operation and/or a device for strengthening the yarn and/or a cutting device and/or an auxiliary winding device for the spool package are housed in a drivable servicing device which, as required, can be applied to one of the spinning units respectively. This servicing device can not only carry out the preparing of a spool package achieving the desired filling ratio but also the complete exchange of the spool and the package.

Other objects, advantages and novel features of the present invention will become apparent from the following detailed description of the invention when considered in conjunction with the accompanying drawings.

DETAILED DESCRIPTION OF THE DRAWINGS

Figure 1:
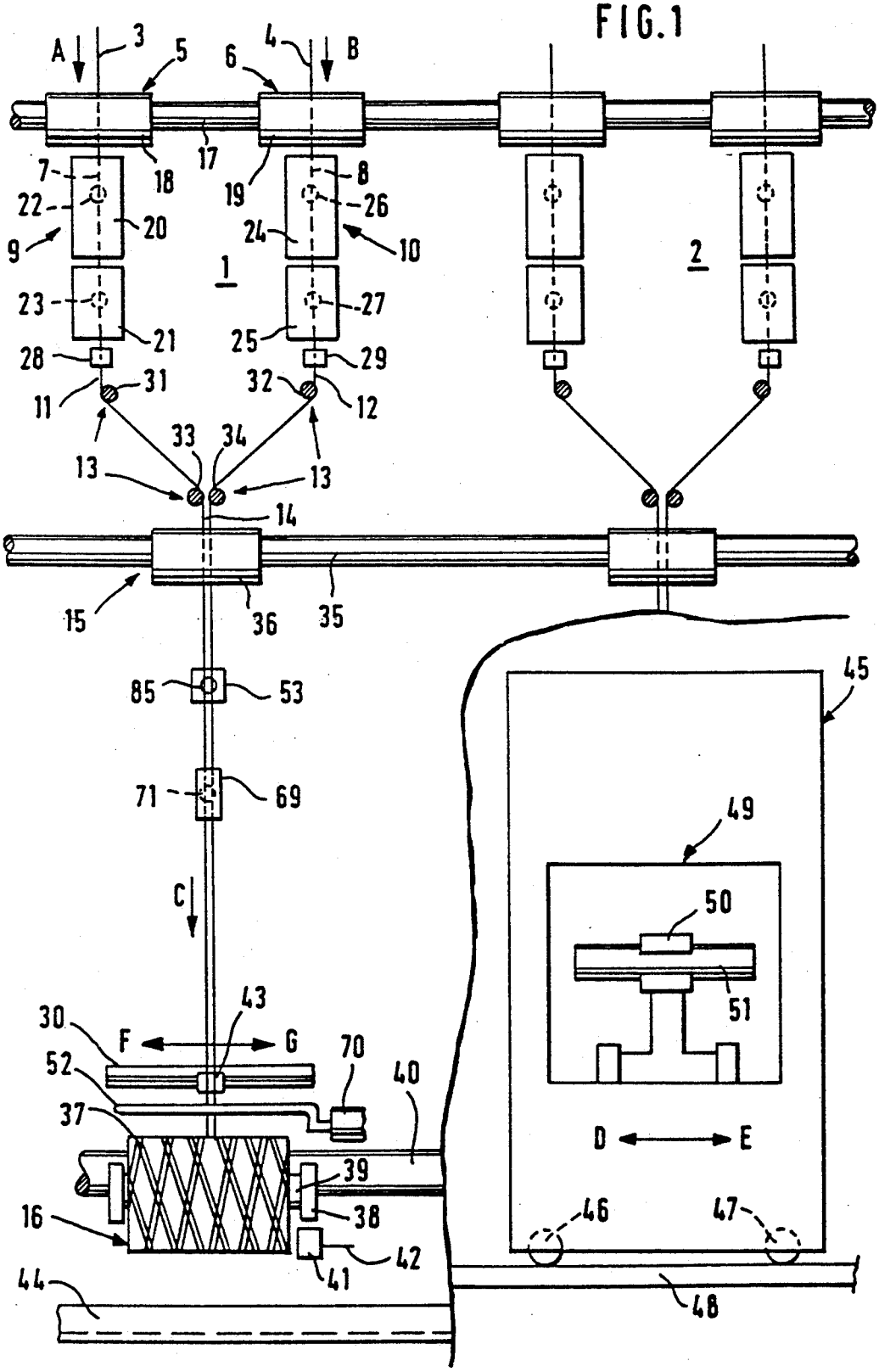
FIG. 1 is a schematic partial view of a spinning machine viewed from the operating side, with a servicing device which can be moved on the side situated behind it, constructed in accordance with preferred embodiments of the invention.

FIG. 1 shows two adjacent spinning units 1, 2 of a spinning machine which has a plurality of spinning units of this type which are arranged next to one another. The spinning unit 2 is shown only partially in order to ensure the visibility of a servicing device 45 which is normally covered. The spinning units 1, 2 each spin two prestrengthened yarn components 11, 12 which are wound side-by-side onto a spool package 37 as a double yarn 14.

Each spinning unit 1, 2 processes two slivers 3, 4 which move through drafting units 5, 6 in the direction of the arrows (A, B,) of which only the pair of delivery rollers is shown. The slivers 7, 8 which are drawn to the desired yarn size in the drafting units 5, 6 enter into directly following false-twisting devices 9, 10 in which they are prestrengthened to yarn components 11, 12. These prestrengthened yarn components 11, 12 are guided together by means of yarn guiding devices 13 to form a double yarn 14 which is withdrawn by a withdrawal device 15. The double yarn 14 then moves along further in the direction of arrow (C) to a wind-up device 16 which winds the double yarn 14 into packages 37 in the form of cross-wound packages. These packages 37 will then be fed to a twisting machine.

The drafting units 5, 6 have bottom rollers which conventionally are constructed as cylinders extending through in the longitudinal direction of the machine, of which only the bottom roller 17 is shown which is part of the pair of delivery rollers. Pressure rollers are assigned to the bottom rollers, of which only the pressure rollers 18, 19 of the pair of delivery rollers are shown. The pressure rollers, in a known manner, are constructed as pressure roller twins which are held by means of a loading support which is not shown and are elastically pressed against the bottom rollers 17.

The drafting units 5, 6 are followed by pneumatic false-twisting devices 9, 10 which each contain two air nozzles 20, 21, 24, 25 which are connected to compressed-air supply lines 22, 23; 26, 27. The respective first air nozzle 20, 24 is constructed as an intake nozzle which provides the drawn slivers 7, 8 with no or almost no twist. The air nozzles 21, 25 which follow are false-twisting nozzles which provide the drawn slivers 7, 8 with a false twist. This false twist opens up behind the air nozzles 21, 25. In this case, some of the yarn ends remain wound around the core which essentially consists of unparallel untwisted fibers. The pneumatic false-twisting devices 9, 10 are directly followed by yarn detectors 28, 29.

The yarn guiding devices 13 consist of yarn guiding pins 31, 32 which are arranged as extensions of the air nozzles 21, 25. In addition, the yarn guiding devices 13 contain other yarn guiding pins 33, 34 which guide the two prestrengthened yarn components 11, 12 together to form a double yarn 14. These two guiding pins 33, 34 maintain a short distance which is selected such that the two prestrengthened yarn components 11, 12 are disposed closely next to one another, but, if possible, do not come in contact with one another.

The yarn guiding pins 33, 34 are followed by a withdrawal device 15 which comprises a shaft 35 extending through in the longitudinal direction of the machine which is driven at the machine end and one pressure shaft 36 respectively which is in elastic contact pressure.

Between the withdrawal device 15 and the winding device 16, a suction nozzle 53 is arranged first which is connected to a suction line 85 controlled by a valve which is not shown. As explained below, the suction nozzle 53 is used as a device for storing the yarn. Behind the suction nozzle 53, a swirl nozzle 69 is arranged which is connected to a compressed-gas line 71 containing a valve which is not shown. The function of this swirl nozzle 69 will also be explained below.

The wind-up device 16 contains a winding roller 40 extending through in the longitudinal direction of the machine and driven at the machine end, the spool package 37 resting against this winding roller 40 during the normal spinning operation and being driven by it. The spool package 37 is held (FIG. 2) by a spool frame 38 which accommodates the spool package tube 39 between two rotatable plates, the package 37 being wound onto the spool tube 39 as a cross-wound package. A cross-winding yarn guide 43 is assigned to the wind-up device 16 and carries out a to-and-fro motion in a guide way 30 in the direction of the arrows (F, G). In addition, devices are part of the wind-up device 16 by means of which the different lengths and tensions of the double yarn are formed which arise during the crossing of the cross-winding yarn guide 43.

Also part of the wind-up device is a yarn guiding bow 52 which is held by a pneumatic or hydraulic cylinder 70 and can also be moved in the direction of the arrows (F and G) by the actuating of the cylinder 70. The function of this yarn guiding bow 52 will also be explained in detail below.

The spool package frame 38 of the wind-up device 16 can be swivelled around a stationary shaft 55 which extends in parallel with respect to the winding roller 40. A control member 56 is assigned to the spool package frame 38 which is applied when it is actuated by means of a pressure element to the spool package frame 38 and swivels it around its shaft 55 in such a manner that the package 37 is lifted off the winding roller 40 and takes up position 37'. At least one arm 54 of the spool package frame 38, in addition, can also be swivelled around a shaft extending transversely with respect to the swivelling shaft 55, so that the spool package frame 38 can be opened up for releasing the package 37. At least approximately vertically below position 37' of the swivelled-away package 37, a conveying belt 44 is arranged which extends in the longitudinal direction of the machine and by means of which the released packages 37" can be moved away.

On the spool package frame 38, a sensor 41 is arranged which monitors the filling ratio of the package 37 and which, when a preselected filling ratio of the spool package 37 is reached, emits a corresponding signal. By way of a line 42, this signal is fed to a control device which is not shown which then triggers a program for stopping the respective spinning unit 1, 2.

Figures 2, 3:
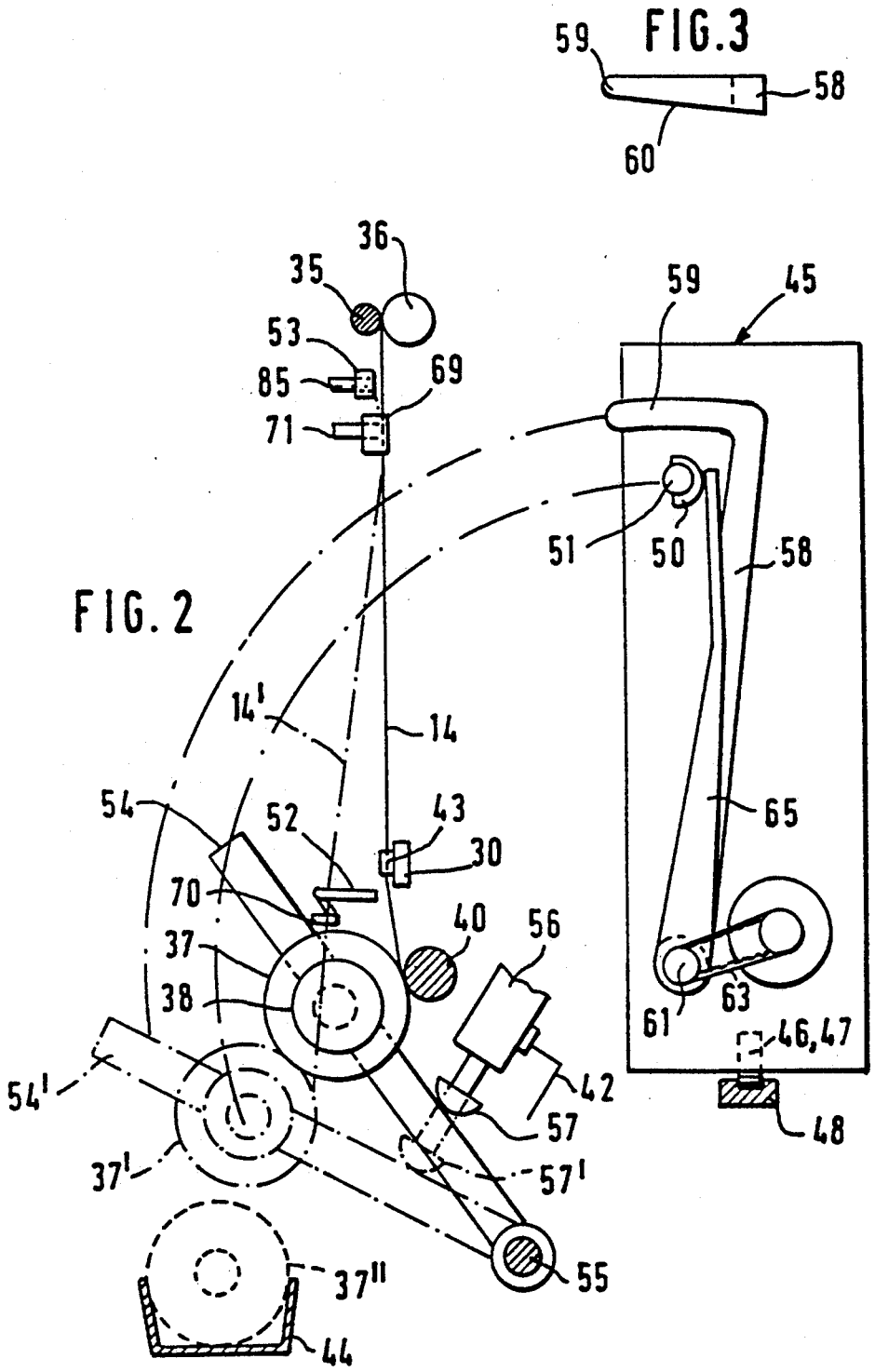
FIG. 2 is a schematic partial lateral view of a spinning unit and of the movable servicing device of FIG. 1.
FIG. 3 is a view of a component part of the servicing device of FIG. 2.

In the simplest implementation of the invention, the spool package 37, in the course of this program, is lifted off the winding roller 40 by means of the actuating of the control element 56 so that it takes up its position 37'. In this case, the double yarn 14 is lifted out of the cross-winding yarn guide 43 so that it takes up position 14' (FIG. 2). The double yarn 14 then moves in the area of the yarn guiding bow 52. The yarn guiding bow 52 has an arm 78 extending diagonally with respect to the shaft of the spool package 37', this arm 78 being followed by a notch 79 which is delimited by two flanks 80 extending essentially transversely to the spool package shaft. The continuously moving double yarn 14' is therefore deposited on the spool package 37 in the form of parallel final windings 77 which are disposed in proximity of one of the front faces 84 of the spool package 37'. The continued delivery of the double yarn 14' is interrupted by interrupting the spinning operation a short time after the swivelling-away of the spool package 37 into position 37'. For this purpose, the continued delivery of the sliver 3, 4 is interrupted by the drafting units 5, 6. This may take place, for example, by the lifting-off of the pressure rollers or by the actuating of a known sliver stopping device. The time during which the double yarn 14' continues to be produced is determined as a function of the delivery speed and the run-down time of the spool package 37'. In addition, during this operation, the swirl nozzle 69 is switched on so that the two yarn components 11, 12 of the double yarn 14' are connected with one another and/or strengthened. In this case, it is provided that an end of the double yarn 14' of a length of approximately 0.5 m is connected with one another.

Figure 5:
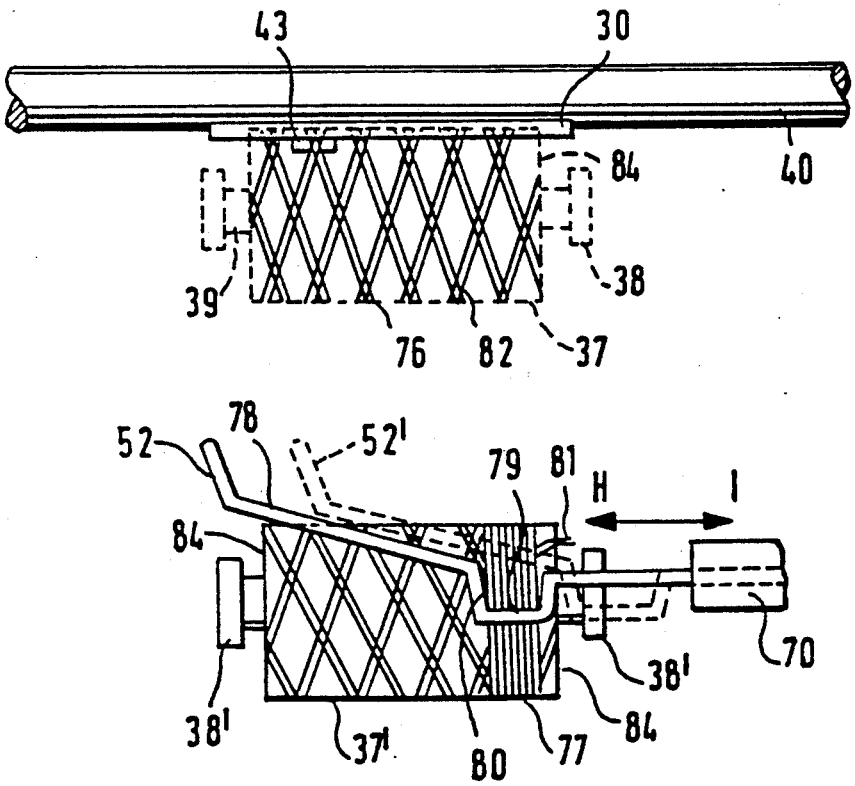
FIG. 5 is a view of the area of the winding device of a spinning unit of the spinning machine while final windings are produced on the spool package.

As shown in FIG. 5, when the end 81 of the double yarn 14' moves onto the spool package, the yarn guiding bow 52 is moved toward one front face 84 of the spool package 37' by means of the cylinder 70, so that the yarn end 81 is displaced toward the outside to the front face 84 of the spool package 37'.

In another embodiment of the invention, the program control system provides that first, by actuating the control member 56, the spool package 37 is lifted off the winding roller 40 and takes up its position 37'. At the same time, the spool package 37', by means of braking devices which are not shown, is brought to a standstill as fast as possible. The double yarn 14 will then take up position 14' (FIG. 2). The production of the double yarn 14' will still be maintained for a short period of time which is a function of the delivery speed and is selected such that approximately one to two meters of double yarn 14' continue to be produced. When the spool package 37 is swivelled into position 37', the suction nozzle 53 is actuated at the same time so that the continuously produced double yarn 14' is sucked into the suction nozzle 53. The subsequent finding of the final windings 77 on the package 37' is carried out by a drivable servicing apparatus 45 which is called upon a signal which is triggered by the sensor 41.

The movable servicing apparatus 45 can be moved on running rails 48 by means of running wheels 46, 47 of which at least one is drivable. The movable servicing apparatus 45 is positioned with respect to the concerned spinning unit 1, 2 and will then carry out the finding of the final windings 77 and the subsequent exchanging of the package and the spool.

Figure 4:
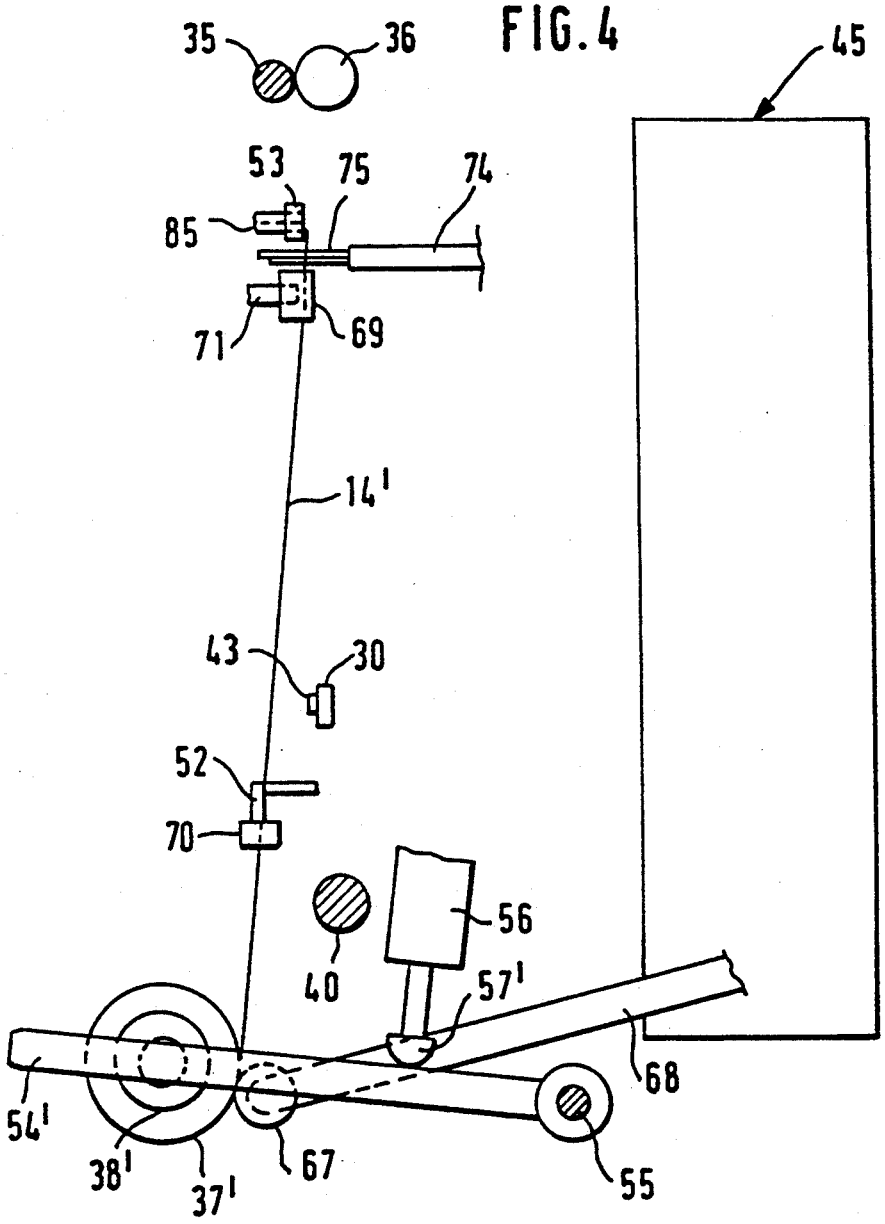
FIG. 4 is a schematic lateral view of a movable servicing apparatus shown while another operation of the servicing process is carried out.

The movable servicing apparatus 45 is equipped with an auxiliary winding roller 67 which is arranged on an arm 68 that can be moved out of the servicing apparatus 45 and which is applied to the spool package 37' lifted off the winding roller 40 (FIG. 4). The auxiliary winding roller 67 will then drive the spool package 37' so that the double yarn 14' is withdrawn from the suction nozzle 53 and is wound onto the spool package 37'. In this case, the yarn guiding bow 52 ensures that the final windings 77 are deposited in the desired form. During the forming of the final windings 77, the swirl nozzle 69 is activated at a given point in time so that the two yarn components 11, 12 of the double yarn 14' along a given length of approximately 0.5 meters are connected with one another and are therefore also strengthened. The servicing apparatus 45 is also equipped with a cutting device 75 which is arranged on an arm 74 which can be moved out and which can be applied to the double yarn 14' in the area between the suction nozzle 53 and the swirl nozzle 69. When the desired length for the final windings 77 is reached, the double yarn 14' is cut off by the cutting device 75 so that the thinned-out yarn end created by the running-out of the slivers 3, 4 is cut off and is sucked off by the suction nozzle 53. Also in this embodiment, it may be provided that the yarn guiding bow 52 is moved in longitudinal direction of the spool package 37' at the end of the winding-up of the final windings 77, so that the cut-off yarn end 81 of the double yarn 14' is displaced to a front face 84 of the spool package 37'.

As shown in FIG. 2 and 3, the movable servicing apparatus 45 is also equipped with devices for the ejecting of the now finished package 37' provided with final windings 77. For this purpose, the servicing apparatus 45 contains a spreader lever 58 which, by means of a toothed belt drive 63, can be swivelled around a shaft 61. The spreader lever 58 contains an arm 59 which has a flank 60 which widens in a wedge shape (FIG. 3). By means of this flank 60, the arm 59 stops against the transversely movable arm 54' of the spool frame 38 so that the package 37' is released, then falls onto the conveyor belt 44 and takes up position 37''. The servicing apparatus 45 also contains a spool tube inserting lever 65 which can also be pivoted around the shaft 61. In a gripper 50, the spool tube inserting lever 65 carries an empty spool tube 51. By means of swivelling, the empty spool tube 51 is brought into the range of the spool frame 38 which was opened up by the swivelling-away of the arm 54'. The spreader lever 58 is then swivelled back into the servicing apparatus 45 so that the spool frame 38 takes over the spool tube 51. Then the gripper 50 is opened up and the lever 65 is moved back into the servicing apparatus 45. This spool package exchange is followed by a piecing operation which will not be discussed here in detail.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A process for forming spool packages at an individual spinning unit of a spinning machine having a plurality of spinning units of the type which each produce at least one yarn which is withdrawn by means of a withdrawal device and is wound onto a spool package by means of a winding device which contains a cross-winding yarn guide distributing the yarn in longitudinal direction of the spool package, in which case, after a given filling ratio of the spool package is reached, the further yarn production at the respective spinning unit is interrupted and a yarn end is wound onto the spool package, said process comprising:

comprising spinning yarn at a spinning unit, cross-winding the yarn being spun at the spinning unit on a spool package arranged at the spinning unit, said cross-winding being performed by a cross-winding yarn guide arranged at the spinning unit, disengaging the yarn being spun from the cross-winding yarn guide when a given filling ratio of the spool package is reached, and subsequently winding the yarn being spun as final windings onto a predetermined longitudinal of the spool package to thereby facilitate location of the yarn end on the completed spool package during subsequent processing of the yarn, and separating the spool package from the winding device in which case the yarn which continues to be produced for a given time period is stored in a storage device connected behind the withdrawal device, after which the stored yarn subsequently is wound up as the final windings bypassing the cross-winding yarn guide when the spool package is driven again.

2. A process according to claim 1, comprising reducing the winding speed of the spool package when the given filling ratio is reached.

3. A process according to claim 1, wherein the spinning unit is of the type which produces a double yarn with prestrengthened components, and wherein the yarn ends wound up during the formation of the final windings is further strengthened before moving onto the spool package.

4. A process according to claim 3, wherein the yarn end moving onto the spool package when the final windings are formed is deposited on the spool package in a predetermined pattern.

5. A process according to claim 1, wherein the spinning unit is of the type which produced a double yarn with two prestrengthened components, and wherein the ends of the two yarn components are connected with one another before moving onto the spool package.

6. A process according to claim 1, wherein the yarn end moving onto the spool package when the final windings are formed is deposited on the spool package in a predetermined pattern.

7. A process according to claim 1, wherein the separating of the spool package from the winding device is done before the yarn is disengaged from the cross-winding yarn guide.

8. A process for forming spool packages at an individual spinning unit of a spinning machine having a plurality of spinning units of the type which each produce a double yarn with prestrengthened yarn components withdrawn by means of a withdrawal device and wound onto a spool package by means of a winding device which contains a cross-winding yarn guide distributing the yarn in longitudinal direction of the spool package, said process comprising:

continuously spinning yarn at a spinning unit, winding the yarn being spun on a spool package until a predetermined filling ratio of the spool package is produced, and subsequently strengthening the double yarn being spun for a given length before it is wound on the spool package to form strengthened double yarn which serves as final windings on the spool package, wherein the final windings are wound onto a predetermined longitudinal area of the spool package to thereby facilitate location of the yarn end on the completed package during subsequent processing of the yarn.

9. A process according to claim 8, comprising reducing the winding speed of the spool package when the given filling ratio is reached.

10. A process according to claim 8, further comprising cutting off an extreme end portion of the double yarn before it is wound as the final windings on the spool package.

11. A process according to claim 8, comprising separating the spool package from the winding device before the yarn is disengaged from the cross-winding yarn guide, in which case the yarn which continues to be produced for a given time period is stored in a storage device connected behind the withdrawal device, after which the stored yarn subsequently is wound up as the final windings bypassing the cross-winding yarn guide when the spool package is driven again.

12. A process according to claim 11, comprising reducing the winding speed of the spool package when the given filling ratio is reached.

13. A process according to claim 12, wherein the spinning unit is of the type which produces a double yarn with prestrengthened components, and wherein the yarn ends wound up during the formation of the final windings is further strengthened before moving onto the spool package.

14. A process according to claim 13, wherein at least one of the winding-up of the final windings, the strengthening, and the cutting-off is carried out by means of a movable servicing device which can be applied to the respective spinning unit.

15. A process according to claim 12, wherein the spinning unit is of the type which produces a double yarn with two prestrengthened components, and wherein the ends of the two yarn components are connected with one another before moving onto the spool package.

16. A process according to claim 12, wherein the yarn end moving onto the spool package when the final windings are formed is deposited on the spool package in a predetermined pattern.

17. A process according to claim 12, wherein the yarn leaving the storage device is cut off the end created by the interruption of the spinning operation.

18. A process according to claim 11, wherein the yarn leaving the storage device is cut off the end created by the interruption of the spinning operation.

19. A process according to claim 18, wherein the spinning unit is of the type which produces a double yarn with prestrengthened components, and wherein the yarn ends wound up during the formation of the final windings is further strengthened before moving onto the spool package.

20. A spinning machine having a plurality of spinning units which each contain:

yarn spinning devices for spinning at least one yarn, withdrawing devices for withdrawing the yarn, cross-winding devices having a cross-winding yarn quite for the winding-up of the yarn, filling ratio detecting devices for detecting the filling ratio of the produced spool package, and interrupting devices for the individual interrupting of the spinning operation at the spinning unit, wherein the detecting devices are connected to devices for reducing the winding speed and to yarn lifting devices for lifting the yarn out of the cross-winding yarn guide in response to reaching a predetermined filling ratio of the spool package, wherein a final winding yarn guiding device is provided which is separately movable with respect to the cross-winding yarn guide and which can be brought into the travel path of the yarn in front of the spool package to guide the final windings on the spool package with the yarn lifted out of the cross-winding yarn guide, wherein a movable servicing device is provided which can be selectively moved to respective spinning units and which includes means for assisting in final winding of spool packages and removal of same from a spinning unit, wherein said movable servicing device includes yarn strengthening devices for strengthening spun yarn before it is wound up as final windings on a spool package.

21. A spinning machine according to claim 20, wherein each spinning unit is equipped with one of the final winding yarn guiding devices.

22. A spinning machine having a plurality of spinning units which each contain:

yarn spinning devices for spinning at least one yarn, withdrawing devices for withdrawing the yarn, cross-winding devices having a cross-winding yarn guide for the winding-up of the yarn, filling ratio detecting devices for detecting the filling ratio of the produced spool package, and interrupting devices for the individual interrupting of the spinning operation at the spinning unit, wherein the detecting devices are connected to devices for reducing the winding speed and to yarn lifting devices for lifting the yarn out of the cross-winding yarn guide in response to reaching a predetermined filling ratio of the spool package, and wherein a final winding yarn guiding device is provided which is separately movable with respect to the cross-winding yarn guide and which can be brought into the travel path of the yarn in front of the spool package to guide the final windings on the spool package with the yarn lifted out of the cross-winding yarn guide.

23. A spinning machine according to claim 22, wherein a movable servicing device is provided which can be selectively moved to respective spinning units and which includes means for assisting in final winding of spool packages and removal of same from a spinning unit.

24. A spinning machine according to claim 23, wherein said movable servicing device includes a an auxiliary winding device for the spool package which is operable to drive the spool package after it has reached said predetermined filling ratio.

25. A spinning machine according to claim 23, wherein said movable servicing device includes the yarn lifting devices.

26. A spinning machine according to claim 23, wherein said movable servicing device includes an interrupting device for interrupting spinning at a spinning unit subsequent to the reaching of a predetermined filling ratio of the spool package.

27. A spinning machine according to claim 22, wherein each spinning unit is equipped with one of the final winding yarn guiding devices.

28. A spinning machine having a plurality of spinning units which each contain:

yarn spinning devices for spinning at least one yarn, withdrawing devices for withdrawing the yarn, cross-winding devices having a cross-winding yarn guide for the winding-up of the yarn, filling ratio detecting devices for detecting the filling ratio of the produced spool package, and interrupting devices for the individual interrupting of the spinning operation at the spinning unit, wherein the detecting devices are connected to devices for reducing the winding speed and to yarn lifting devices for lifting the yarn out of the cross-winding yarn guide in response to reaching a predetermined filling ratio of the spool package, wherein a final winding yarn guiding device is provided which is separately movable with respect to the cross-winding yarn guide and which can be brought into the travel path of the yarn in front of the spool package to guide the final windings on the spool package with the yarn lifted out of the cross-winding yarn guide, and wherein each spinning unit is equipped with a storage device for storing the spun yarn, said storage device being arranged in the travel direction of the yarn downstream of the withdrawal device.

29. A spinning machine according to claim 28, wherein each spinning unit is equipped with devices for lifting the spool package off the drive of the winding device.

30. A spinning machine according to claim 28, wherein each spinning unit is equipped with a strengthening device for strengthening the yarn, which strengthening device is arranged downstream of the storage device in the travel direction of the yarn.

31. A spinning machine according to claim 30, wherein a cutting device is provided which is connected downstream of the storage device in the travel direction of the yarn.

32. A spinning machine according to claim 28, wherein a cutting device is provided which is connected downstream of the storage device in the travel direction of the yarn.

33. A spinning machine according to claim 28, wherein each spinning unit is equipped with one of the final winding yarn guiding devices.

34. A spinning machine having a plurality of spinning units which each contain:

yarn spinning devices for spinning at least one yarn, withdrawing devices for withdrawing the yarn, cross-winding devices having a cross-winding yarn guide for the winding-up of the yarn, filling ratio detecting devices for detecting the filling ratio of the produced spool package, and interrupting devices for the individual interrupting of the spinning operation at the spinning unit, wherein the detecting devices are connected to devices for reducing the winding speed and to yarn lifting devices for lifting the yarn out of the cross-winding yarn guide in response to reaching a predetermined filling ratio of the spool package, wherein a final winding yarn guiding device is provided which is separately movable with respect to the cross-winding yarn guide and which can be brought into the travel path of the yarn in front of the spool package to guide the final windings on the spool package with the yarn lifted out of the cross-winding yarn guide, wherein a movable servicing device is provided which can be selectively moved to respective spinning units and which includes means for assisting in final winding of spool packages and removal of same from a spinning unit, and wherein said movable servicing device includes a yarn storage device for storing yarn during final winding on a spool package after the yarn is lifted out of the cross-winding yarn guide.

35. A spinning machine according to claim 34, wherein each spinning unit is equipped with one of the final winding yarn guiding devices.

36. Apparatus for forming spool packages at an individual spinning unit of a spinning machine having a plurality of spinning units of the type which each include spinning devices for spinning a double yarn with a pair of prestrengthened yarn components, a withdrawal device for withdrawing the yarn components, and a winding device for winding the yarn components onto a spool package, said winding device including a cross-winding yarn guide for distributing the yarn in longitudinal direction of the spool package, said apparatus further comprising:

filling ratio detecting means for detecting the filling ratio of the spool package being produced and for emitting a signal when a predetermined filling ratio is reached, and subsequent yarn strengthening means for subsequently strengthening the double yarn being spun before it is wound onto the spool package and subsequent to said signal, whereby strengthened double yarn is formed which serves as final windings on the spool, wherein the final windings are wound onto a predetermined longitudinal area of the spool package to thereby facilitate location of the yarn end on the completed package

37. An apparatus according to claim 36, further comprising a cutting device for cutting off an extreme end portion of the double yarn before it is wound as the final windings of the spool package.

38. A process for forming spool packages at an individual spinning unit of a spinning machine having a plurality of spinning units of the type which each produce at least one yarn which is withdrawn by means of a withdrawal device and is wound onto a spool package by means of a winding device which contains a cross-winding yarn guide distributing the yarn in longitudinal direction of the spool package, in which case, after a given filling ratio of the spool package is reached, the further yarn production at the respective spinning unit is interrupted and a yarn end is wound onto the spool package, said process comprising:

continuously spinning yarn at a spinning unit, cross-winding the yarn being spun at the spinning unit on a spool package arranged at the spinning unit, said cross-winding being performed by a cross-winding yarn guide arranged at the spinning unit, disengaging the yarn being spun from the cross-winding yarn guide when a given filling ratio of the spool package is reached, and subsequently winding the yarn being spun as final windings to thereby facilitate location of the yarn end on the completed spool package during subsequent processing of the yarn, wherein the spinning unit is of the type which produces a double yarn with prestrengthened components, and wherein the yarn ends wound up during the formation of the final windings is further strengthened before moving onto the spool package.

39. A process for forming spool packages at an individual spinning unit of a spinning machine having a plurality of spinning units of the type which each produce at least one yarn which is withdrawn by means of a withdrawal device and is wound onto a spool package by means of a winding device which contains a cross-winding yarn guide distributing the yarn in longitudinal direction of the spool package, in which case, after a given filling ratio of the spool package is reached, the further yarn production at the respective spinning unit is interrupted and a yarn end is wound onto the spool package, said process comprising:

continuously spinning yarn at a spinning unit, cross-winding the yarn being spun at the spinning unit on a spool package arranged at the spinning unit, said cross-winding being performed by a cross-winding yarn guide arranged at the spinning unit, disengaging the yarn being spun from the cross-winding yarn guide when a given filling ratio of the spool package is reached, and subsequently winding the yarn being spun as final windings to thereby facilitate location of the yarn end on the completed spool package during subsequent processing of the yarn, wherein the spinning unit is of the type which produces a double yarn with prestrengthened components, and wherein the spinning unit is of the type which produced a double yarn with two prestrengthened components, and wherein the ends of the two yarn components are connected with one another before moving onto the spool package.

40. A spinning machine having a plurality of spinning units which each contain:

yarn spinning devices for spinning at least one yarn, withdrawing devices for withdrawing the yarn, cross-winding devices having a cross-winding yarn guide for the winding-up of the yarn, filling ratio detecting devices for detecting the filling ratio of the produced spool package, and interrupting devices for the individual interrupting of the spinning operation at the spinning unit, wherein the detecting devices are connected to devices for reducing the winding speed and to yarn lifting devices for lifting the yarn out of the cross-winding yarn guide in response to reaching a predetermined filling ratio of the spool package, wherein a final winding yarn guiding device is provided which is separately movable with respect to the cross-winding yarn guide and which can be brought into the travel path of the yarn in front of the spool package to guide the final windings on the spool package with the yarn lifted out of the cross-winding yarn guide.

* * * * *